United States Patent [19]

Cheng

[11] Patent Number: 4,723,668

[45] Date of Patent: Feb. 9, 1988

[54] FEEDING BOTTLE STRUCTURE WITH VALUE

[76] Inventor: Ping N. Cheng, No. 45, Ho I Rd., Keelung City, Taiwan

[21] Appl. No.: 942,776

[22] Filed: Dec. 17, 1986

[51] Int. Cl.[4] ..... A61J 9/00; A61J 9/04

[52] U.S. Cl. ..... 215/11.5; 220/DIG. 7

[58] Field of Search ..... 215/11 R, 11 B, 11 D, 215/100 R, 11 C, 11 E; 137/511, 512.4, 843, 845, 854; 220/DIG. 27, 85 P

[56] References Cited

U.S. PATENT DOCUMENTS

| | | | |
|---|---|---|---|
| 362,554 | 5/1887 | Soydam | 215/11 B |
| 533,726 | 2/1895 | McBride | 215/11 B |
| 2,394,722 | 2/1946 | Sloane | 215/11 B |
| 3,134,495 | 5/1964 | Carbonel | 215/11 B |
| 4,010,861 | 3/1977 | Welten | 215/11 B |

FOREIGN PATENT DOCUMENTS

| | | | |
|---|---|---|---|
| 57694 | 2/1913 | Austria | 215/11 B |
| 14729 | of 1891 | United Kingdom | 215/11 B |
| 2139903 | of 1984 | United Kingdom | 215/11 R |

*Primary Examiner*—William Price
*Assistant Examiner*—Sue A. Weaver
*Attorney, Agent, or Firm*—Bacon & Thomas

[57] ABSTRACT

A bottle with male threads on the outer bottom surface and a protruding surface on the base thereof; a silicon rubber layer provided with an elastic protrusion which has a slit on the top; a base casing with female threads on its inner surface and a minute vent centered thereon. The slit on the elastic protrusion remains closed in normal (non-suction) condition thereby, preventing the milk or liquid inside the bottle from dripping out. Once the bottle is inverted and the nipple is sucked, the slit opens a certain amount to let the air flow into the bottle. Thus, milk flows out of the nipple continuously during suction.

1 Claim, 3 Drawing Figures

FEEDING BOTTLE STRUCTURE WITH VALUE

BACKGROUND OF THE INVENTION

This invention relates to an improved feeding bottle structure, more particularly, to a structure which provides the infant with a convenient way of sucking milk from the feeding bottle, and furthermore, which is easy to clean and is hygienic.

In previous designs, feeding bottles comprised a bottle main body and a nipple. Conventional bottle is often made of plastic material, while the nipple is made of silicon rubber which is relatively soft and can be twisted or curled. In early designs, there was only one opening provided on the nipple within the whole structure for sucking purpose. However, since the bottle was a completely enclosed chamber, the nipple often became deformed as a result of pressure difference. This resulted in a non-continuous flow of milk from the nipple opening so that the infant had to stop sucking for a while to let the nipple recover to its initial state. To a little baby, this is a significant problem. In response to the above-discussed problems, an improved structure has been developed which comprises an one-way inward opening at the lower portion of the nipple. When a baby sucks on the nipple, air may flow in through said opening so that sucking can proceed continuously. However, the aforementioned structure allows for a direct contact between said opening and milk. Consequently, coagulated milk fat often accumulated and blocked the opening. Thus, said opening lost its function of adjusting the pressure and the good effect of said structure is seriously compromised and curtailed. The reason that the small opening provided on the nipple gets clogged up is that the opening is not easily cleaned and therefore, residual milk fat may remain lodged around the opening. Furthermore, there is direct contact between milk and air when said structure is utilized. The dirt in air may contaminate the milk and bubbles exist in the milk as well. These bubbles (i.e., air) and dirt may get into the body of the infant, and thus result in an undesirable effect on the health of the infant. Obviously, said feeding bottle structure has many drawbacks.

SUMMARY OF THE INVENTION

It is, therefore, a primary objective of this invention to provide a convenient, easy-to-suck feeding bottle structure which can be readily produced.

Another objective of this invention is to provide a hygienic feeding bottle structure which can be easily cleaned.

A further objective of this invention is to provide a stable feeding bottle structure which has a lower center of gravity, and therefore does not easily fall down.

Further objectives and advantages of the present invention will become apparent as the following description proceeds, and the features of novelty which characterize the invention be pointed out with particularly in the claims annexed to and forming a part of this invention.

DETAILED DESCRIPTION OF THE PREFERRED EMBODIMENT

Figure 1:
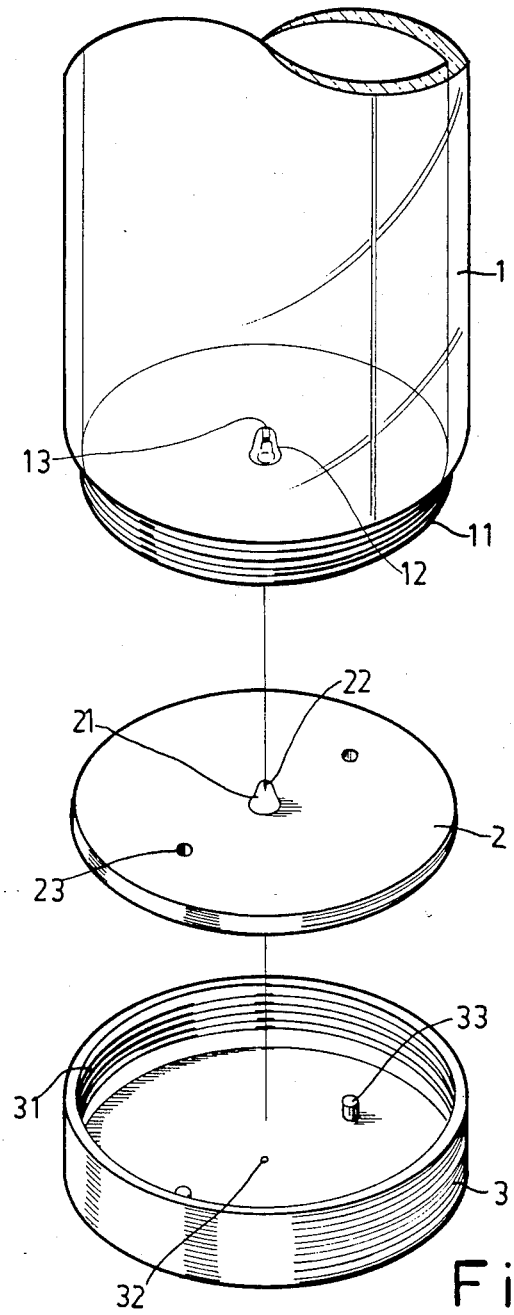
FIG. 1 is a fragmentary perspective, exploded view of an improved feeding bottle structure in acordance with the present invention.
Figure 2:
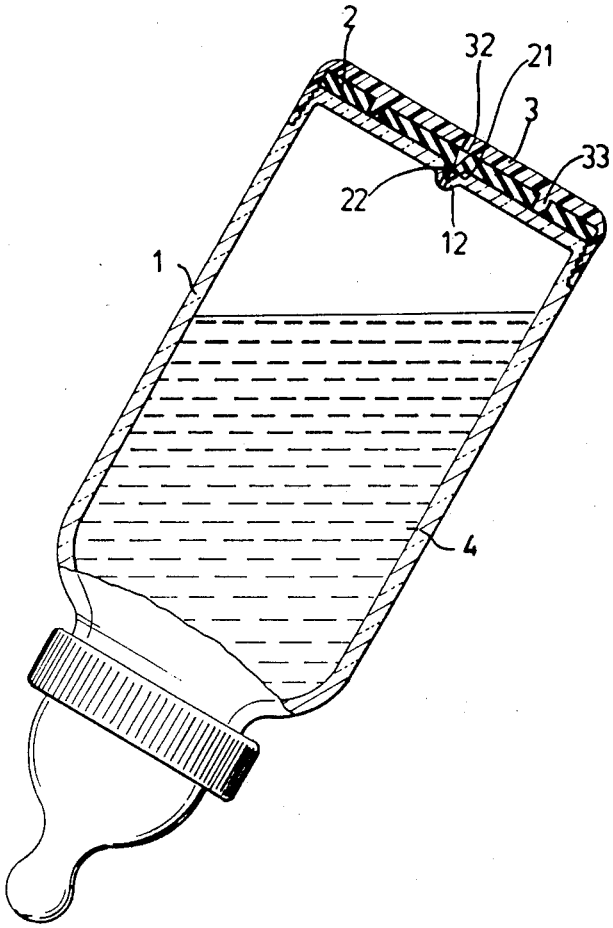
FIG. 2 is a cross-sectional view of the improved feeding bottle structure shown in inverted (non-suction) position.
Figure 3:
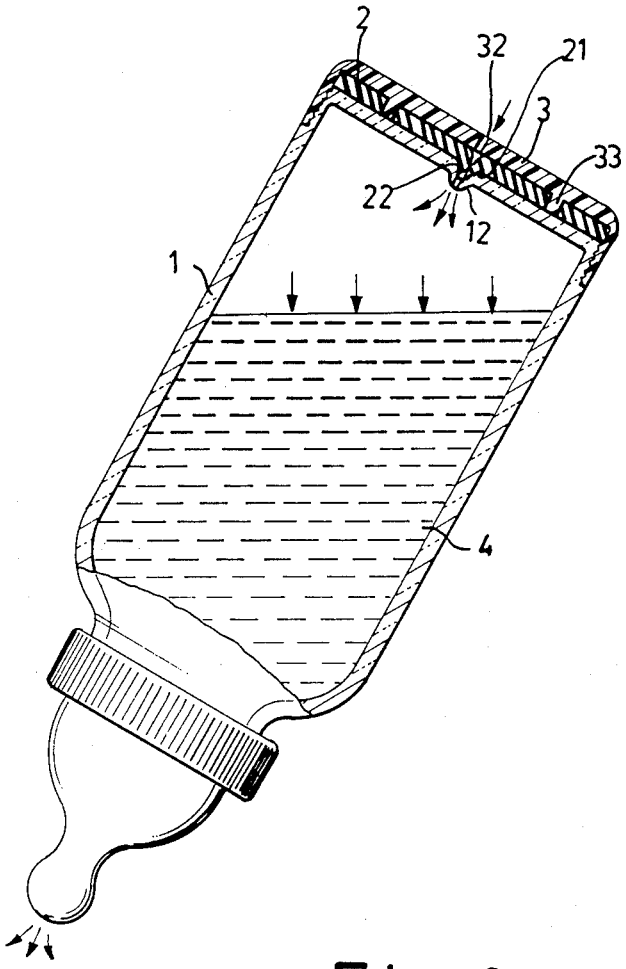
FIG. 3 is a cross-sectional view of the improved feeding bottle structure, shown in inverted (suction) position.

Referring now to FIG. 1, it can be seen that the improved feeding bottle structure according to the present invention comprises a bottle 1 provided with male threads 11 on the outer surface at the lower portion thereof and a protruding surface 12 on the base thereof. Moreover, the top of said protruding surface 12 is provided with an opening 13. As shown in FIGS. 2 and 3, bottle 1 also includes a nipple 14 provided with an aperture 15 at its end.

A silicon rubber layer 2 is provided with an elastic protrusion 21 in a suitable location thereof. Moreover, said elastic protrusion 21 has a vertical slit 22 on its top. The slit 22 remains closed during normal (non-suction) conditions. The silicon rubber layer 2 is also provided with two spaced fixing slots 23, one on each side of the elastic protrusion 21.

The cylindrical base casing 3 comprises female threads 31 on its inner surface and two fixing rods 33 on its base as well as a minute vent 32 positioned so as to be in alignment with said elastic protrusion 21. The fixing rods 33 are located such that the silicon rubber layer 2 can be combined with the base casing 3 by inserting the fixing rods 33 into the fixing slots 23. Furthermore, the whole structure may be combined together by screwing the female threads 31 of base 3 onto the male threads 11 of the bottle 1. The overall structure of the present invention is thereby assembled.

When the improved feeding bottle structure is filled with milk or liquids and in non-suction condition, the slit 22 on elastic protrusion 21 remains tightly closed no matter how the feeding bottle is placed or located. As can be seen in FIG. 2, no milk 4 drips or leaks from the feeding bottle 1. When the bottle 1 is in inverted (suction) position, the elastic protrusion 21 of the silicon rubber layer 2 is pressed by atmospheric pressure making the vertical slit 22 open a certain amount to let air flow into the bottle 1 through the vent 32. This is because of the reduced pressure inside of the bottle, which is a direct consequence of the baby sucking thereon. The flowing of air from the slit 22 and opening 13 to the bottle 1 allows a baby to suck and drink the milk continuously without any blockage or disturbance.

In conclusion, the improved feeding bottle structure in this invention provides an easy-to-suck means for infants which allows air to enter from the base of the bottle 1. As can be seen in FIG. 2, the slit 22 has no direct contact with milk 4, and therefore, neither contamination nor bubbles occur or exist in such structure. Moreover, the base casing 3 can be opened or disassembled easily, and the components of the structure can be separately washed. Consequently, milk fat no longer clogs up the slit 22. Furthermore, the bottom of the present structure has increased weight at the bottom of the feeding bottle, so that the center of gravity is at a lower position than the prior art devices, and therefore does not easily fall down.

A best mode and preferred embodiment having been set forth in detail herein, the scope of the invention is not limited thereby, but rather by the scope of the attached claims.

I claim:

1. An improved feeding bottle structure comprising:

(a) a bottle having a cylindrical outer surface and a base, male threads provided on the outer surface around the base, and a protruding surface on the base within the interior of the bottle, the protruding surface including an opening on the top thereof and defining a cavity open to the exterior of the bottle;

(b) a silicon rubber layer for engagement against the base, the layer including an elastic protrusion disposed on an upper portion thereof and configured for disposition within the cavity of the protruding surface when the layer is disposed in engagement against the base, the elastic protrusion including a vertical slit on the top and two fixing slots disposed on opposite sides thereof; and (c) a cylindrical casing provided with female threads for threaded engagement with the male threads of the base, the casing including a pair of fixing rods disposed on an upper portion thereof for insertion through the fixing slots of the rubber layer, a minute vent in the casing, the vent being disposed in alignment with the elastic protrusion and the elastic protrusion being disposed within the cavity of the protruding surface when the casing is threadedly engaged with the base.

* * * * *